US006724144B2

(12) United States Patent
Takeji et al.

(10) Patent No.: US 6,724,144 B2
(45) Date of Patent: Apr. 20, 2004

(54) DISCHARGE LAMP

(75) Inventors: Yasaburo Takeji, Kyoto (JP); Shinji Taniguchi, Kyoto (JP)

(73) Assignee: Japan Storage Battery Co., Ltd., Kyoto (JP)

( * ) Notice: Subject to any disclaimer, the term of this patent is extended or adjusted under 35 U.S.C. 154(b) by 139 days.

(21) Appl. No.: 09/979,091

(22) PCT Filed: Mar. 21, 2001

(86) PCT No.: PCT/JP01/02223

§ 371 (c)(1),
(2), (4) Date: Nov. 19, 2001

(87) PCT Pub. No.: WO01/71768

PCT Pub. Date: Sep. 27, 2001

(65) Prior Publication Data

US 2002/0179859 A1 Dec. 5, 2002

(30) Foreign Application Priority Data

Mar. 21, 2000 (JP) ..... P.2000-079166

(51) Int. Cl.[7] ..... H01J 17/16; H01J 61/30

(52) U.S. Cl. ..... 313/634; 313/623; 313/625; 313/493; 250/493.1

(58) Field of Search ..... 313/623, 634, 313/625, 493; 250/493.1

(56) References Cited

U.S. PATENT DOCUMENTS

| | | | | |
|---|---|---|---|---|
| 4,387,067 A | * | 6/1983 | Kobayashi et al. | 264/636 |
| 5,424,609 A | | 6/1995 | Geven et al. | |
| 5,994,839 A | | 11/1999 | Yamamoto et al. | |
| 6,126,887 A | | 10/2000 | Ward et al. | |
| 6,208,070 B1 | | 3/2001 | Sugimoto et al. | |
| 6,495,960 B1 | * | 12/2002 | Takeji et al. | 313/634 |

FOREIGN PATENT DOCUMENTS

| | | |
|---|---|---|
| EP | 1 058 288 A1 | 12/2000 |
| EP | 1 089 321 A1 | 4/2001 |

* cited by examiner

*Primary Examiner*—Nikita Wells
(74) *Attorney, Agent, or Firm*—Sidley Austin Brown & Wood LLP

(57) ABSTRACT

An arc tube 6 of discharge lamp comprises a main tube body 11 of translucent ceramic sealed with a terminal plate 13 at both ends thereof. The main tube body 11 comprises integrally a large diameter portion 11A, a tapered portion 11B which is disposed at both sides of the large diameter portion 11A and has a smaller diameter toward the forward end thereof, and a small diameter portion 11C connected to the forward end of the tapered portion 11B. The curvature radius R of the border of the tapered portion 11B with the small diameter portion 11C is not smaller than 2 mm.

4 Claims, 2 Drawing Sheets

DISCHARGE LAMP

TECHNICAL FIELD

The present invention relates to a discharge lamp comprising a translucent ceramic tube dosed with a metal halide and more particularly to a discharge lamp having a raised output.

BACKGROUND ART

An arc tube of this kind of a discharge lamp comprises a tube body which is made of translucent ceramic such as polycrystalline alumina and is tapered at both ends thereof to form a narrow tube portion at an end portion there of, and an electrode lead which is connected to an electrode and inserted in and sealed to the narrow tube portion with a sealing glass.

However, it was extremely difficult for this kind of a discharge lamp to provide the arc tube with an output as high as not lower than 150 W. The reason is as follows. In order to provide a higher output, the diameter of the tube body must be increased to prevent the temperature of the tube body from rising to abnormally high temperature. This makes the difference in diameter between the narrow tube portion of the tube body and the other portions considerably great, producing a sharply bent portion. Firstly, ceramic can hardly be formed into this shape, adding to cost. Further, even if this difficulty can be overcome, the temperature of the bent portion reaches an extremely high value during lighting of discharge lamp, making the bent portion more subject to cracking due to thermal impact. On the contrary, when the diameter of the narrow tube portion is increased, the gap between the narrow tube portion and the electrode lead increases, adding to the thickness of the sealing glass layer with which they are sealed to each other and hence raising a problem that the sealing glass layer can crack.

Therefore, an object of the invention is to improve the structure of the tube body of the arc tube, making it possible to provide a discharge lamp with a higher output, and prevent the occurrence of crack due to heat cycle, making it possible to prolong the life of discharge lamp.

DISCLOSURE OF THE INVENTION

In order to solve the foregoing problems, the inventors made extensive studies of shape of main tube body of arc tube. As a result, it was found that the output as high as not lower than 150 W and the prolongation of life can be together realized by arranging the main tube body in a form having a large diameter portion, a tapered portion disposed on both sides of the large diameter portion having a smaller diameter toward the forward end thereof and a small diameter portion connected to the forward end of the tapered portions wherein the tapered portion and the small diameter portion are connected to each other with a border having a curvature radius of not smaller than 2 mm.

The greater the curvature radius of the border of the tapered portion with the small diameter portion is, the more can be relaxed the thermal stress concentrated thereonto and can be inhibited the occurrence of crack even if the lamp output is high. From this standpoint of view, the curvature radius of the border of the tapered portion with the small diameter portion is more preferably not smaller than 5 mm. The curvature radius of the border is preferably greater but is preferably not greater than 12 mm, particularly not greater than 9 mm.

Further, the arrangement is more desirable such that a terminal plate of ceramic is fitted in and airtightly fixed to the interior of the small diameter portion of the main tube body, the terminal plate has an arrow tube of ceramic piercing there through and airtightly fixed thereto and the narrow tube has an electrically-introducing member with the electrode inserted and airtightly sealed thereto with a sealing glass. In this arrangement, the diameter of the small diameter portion can be increased, making it possible to reduce the angle of the tapered portion accordingly. This means that the wall surface of the tapered portion can be kept away from the electrode, making it possible to prevent the tapered portion and hence the border of the tapered portion with the small diameter portion from rising in its temperature and thus making it possible to provide a discharge lamp with a higher output. Further, the rise of temperature of the foregoing border can be inhibited, making it possible to effectively prevent the occurrence of crack and enhance the reliability of the sealed portion of the electrically-introducing member in the narrow tube. Thus, the life of the discharge lamp can be further prolonged. However, the present invention is not limited to the foregoing structure comprising a terminal plate fitted in a small diameter portion. Another structure may be employed such that the electrically-introducing member is directly inserted in the small diameter portion.

It is more desirable that the thickness of the foregoing terminal plate be from not smaller than 2 mm to not greater than 3 mm. This is because when the thickness of the terminal plate falls below 2 mm, the air tightness of the terminal plate with the narrow tube can be difficultly kept fair. On the contrary, when the thickness of the terminal plate exceeds 3 mm, the heat capacity of the terminal plate increases, producing a great temperature difference in the ceramic tube and hence causing crack on the ceramic tube. It is further desirable that the protruding length of the electrode represented by the distance between the end of the small diameter portion and the forward end of the electrode in the arc tube be from not smaller than 3 mm to not greater than 6 mm. This is because when the protruding length of the electrode falls below 3 mm, the temperature of the portion sealed with a sealing glass rises too much, causing the sealed portion to crack due to sudden thermal expansion developed by the repetition of switching of lamp on and off. On the contrary, when the protruding length of the electrode exceeds 6 mm, the temperature of the interior of the narrow tube can difficultly be raised, making it difficult to provide sufficient luminous characteristics.

BEST MODE FOR CARRYING OUT THE INVENTION

Figure 1:
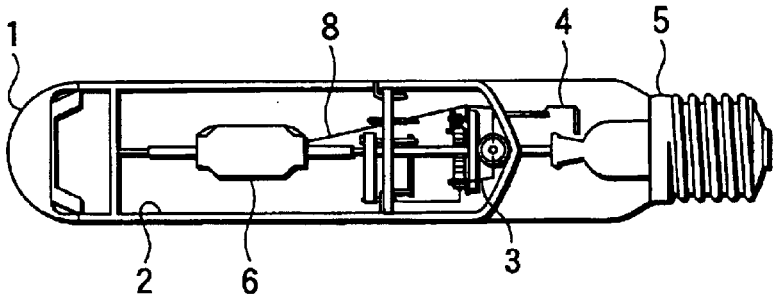
FIG. 1 is a schematic sectional view of discharge lamp illustrating an embodiment of implication of the present invention.

FIG. 1 illustrates a discharge lamp according to the first embodiment of the present invention. This structure comprises an outer bulb 1 of glass having an arc tube 6 supported therein with a supporting frame 2 made of metal rod. In the outer bulb 1 are encapsulated a starter 3 for causing the generation of pulse voltage, a getter 4, and a metallic ignition aid 8 comprising a metal wire provided along the arc tube 6 to facilitate starting. The outer bulb 1 comprises a cap 5 provided at the end thereof.

Figure 2:
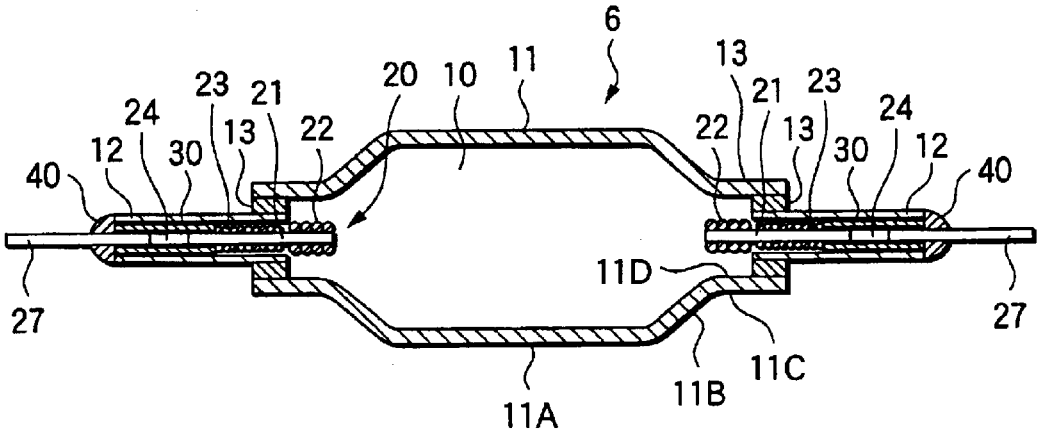
FIG. 2 is a sectional view of an arc tube.
Figure 3:
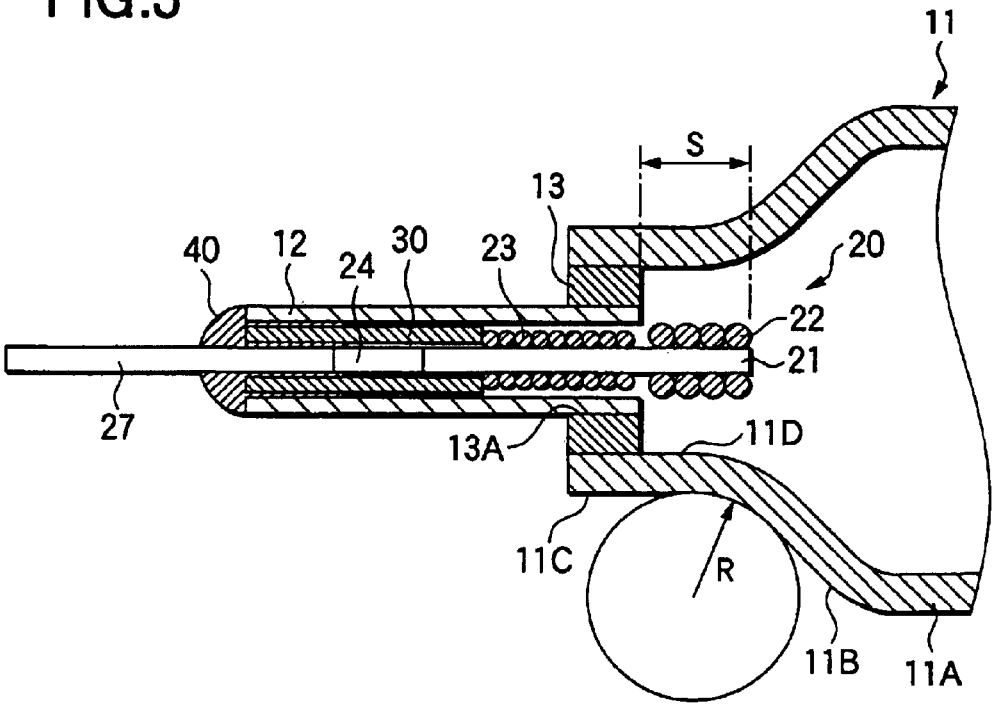
FIG. 3 is an enlarged sectional view of a narrow tube portion.

The structure of the arc tube 6 is shown in detail in FIG. 2. The arc tube 6 comprises a main tube body 11 made of translucent alumina and a narrow tube 12 attached to the main tube body 11 at both ends thereof with the interposition of a terminal plate 13 formed of translucent alumina. The main tube body 11 comprises integrally a large diameter portion 11A which is formed in a true cylinder having a greater inner and outer diameters than other portions over a predetermined range, a tapered portion 11B which is connected to the large diameter portion 11A at both ends thereof and formed in a cylinder having a smaller diameter toward the forward end thereof, and a small diameter portion 11C which is connected to the forward end of the tapered portion 11B and formed in a true cylinder over a predetermined length. The main tube body 11 is formed, e.g., by extruding alumina clay into a true cylinder, cutting the cylinder into a predetermined size, receiving the cylinder in a mold, blowing pressurized air into the cylinder so that the middle portion thereof is expanded to give a desired form, and then calcining the material. The border of the tapered portion 11B with the small diameter portion 11C has a smoothly continuous concave outer surface as shown in FIG. 3. The curvature radius of the concave surface is predetermined to be not smaller than 2 mm.

The terminal plate 13 is in the form of a disc. The terminal plate 13 is fitted in and integrally sintered to the outer end of the smaller diameter portions of 11C of the main tube body 11 that it is airtightly fixed to the main tube body 11. The thickness of the terminal plate 13 is from 2mm to 3 mm, which is smaller than the length of the small diameter portion 11C. Accordingly, a straight cylinder 11D is formed backward the small diameter portion 11C. Thus, it is more desirable that the terminal plate 13 be mounted across the straight cylinder 11D having a predetermined length from the end of the tapered portion 11B to prevent crack.

The terminal plate 13 has a through-hole 13A formed at the center thereof. The through-hole 13A has the narrow tube 12 of alumina inserted and fixed thereto. The interior of the narrow tube 12 has electrically-introducing members 24 and 27 connected to an electrode 20 and a ceramic sleeve 30 of translucent alumina, which are airtightly fixed to the narrow tube 12 with a sealing glass 40.

The electrode 20 comprises a first coil 22 wound on the forward end of an electrode core 21 and a second coil 23 wound on the base of the electrode core 21. The first coil 22 extends into the interior of the main tube body 11 from the narrow tube 12. The electrode core 21 of the electrode 20 has the rod-shaped electrically-introducing member 24 butt-welded thereto at the base thereof, and the electrically-introducing member 24 has the rod-shaped electrically-introducing member 27 butt-welded thereto so that the electrically-introducing member 27 extends out of the narrow tube 12. The purpose of the first coil 22 is to protect the electrode 20 against high temperature of arc spot formed at the forward end of the electrode during lighting of lamp. The purpose of the second coil 23 is to allow the heat of the forward end of the electrode to escape to the rear of the electrode and to position the ceramic sleeve 30.

By forming the main tube body 11 of the arc tube 6 by the terminal plate 13 having the foregoing arrangement, the main tube body 11 can be produced easily, making it possible to drastically reduce cost. Further, by predetermining the curvature radius R of the border of the tapered portion 11B with the small diameter portion 11C in the main tube body 11 to be not smaller than 2 mm, the occurrence of crack can be prevented. Moreover, by predetermining the protruding length of the electrode represented by the distance S between the inner end of the terminal plate 13 and the forward end of the electrode in FIG. 3 to be from 3 mm to 6 mm, sufficient luminous characteristics can be obtained while preventing the occurrence of crack.

Figure 4:
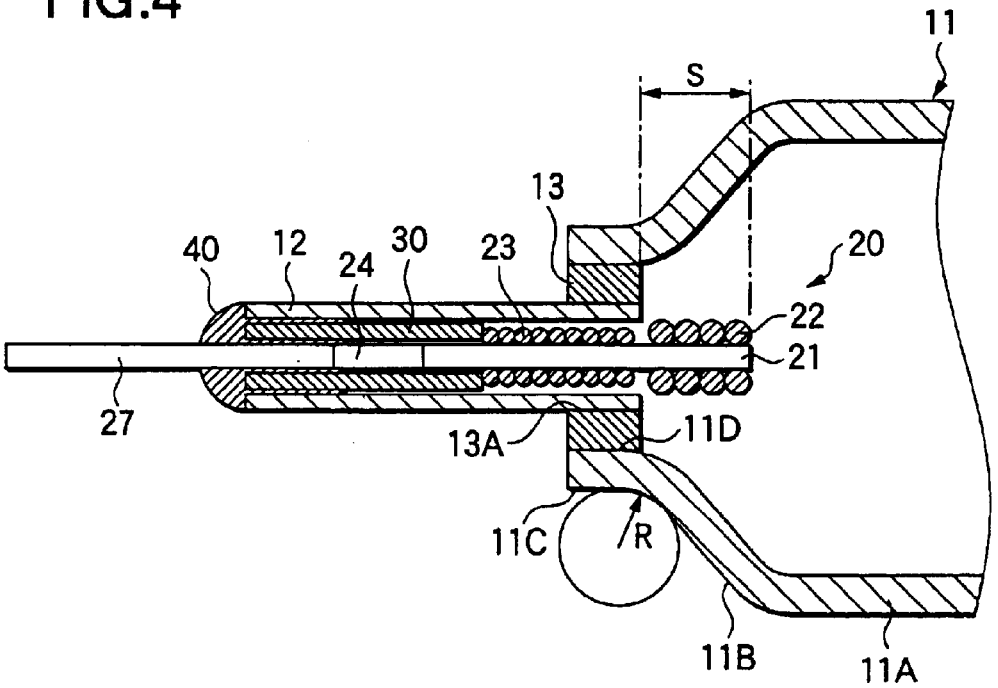
FIG. 4 is a sectional view of arc tube illustrating another embodiment of implication of the present invention.

The axial dimension of the small diameter portion 11C of the main tube body 11 may be predetermined to be the same as the thickness of the terminal plate 13 as shown in FIG. 4.

EXAMPLE 1

Example 1 using an arc tube 6 having the structure shown in FIGS. 2 and 3 will be described hereinafter. The power consumption of the discharge lamp is 250 W. The inner diameter of the large diameter portion 11A of the main tube body 11 is 13 mm, the inner diameter of the small diameter portion 11C is 7 mm, the curvature radius R of the border of the tapered portion 11B with the small diameter portion 11C is 2.5 mm, the thickness of the terminal plate 13 is 2.5 mm, the length of the straight cylinder 11D disposed between the position at which the terminal plate 13 is mounted and the tapered portion 11B is 2 mm, the inner diameter of the narrow tube 12 disposed at both ends of the main tube body 11 is 1.5 mm, the protruding length of the electrode is 4 mm, and the distance between the electrodes is 20 mm. The diameter of the electrode core 21 is 0.7 mm. As the first coil 22, a tungsten wire having a diameter of 0.25 mm is wound on the electrode core 21 by four or five turns. The maximum diameter of the first coil 22 is 1.2 mm. The electrically-introducing member 24 is made of molybdenum and has a diameter of 0.5 mm and a length of 3 mm. The electrically-introducing member 27 is a niobium wire having a diameter of 0.7 mm. The ceramic sleeve 30 is made of alumina and has an inner diameter of 0.75 mm, an outer diameter of 1.4 mm and a length of 8 mm. The electrically-introducing member 27 is fixed to the interior of the narrow tube 12 with a sealing glass 40 over a length of about 3 mm from the forward end thereof. As the sealing glass 40 there was used $Al_2O_3$—$SiO_2$—$Dy_2O_3$-based glass. The sealing glass 40 fills the gap between the electrically-introducing members 24, 27 and the alumina sleeve 30 and between the alumina sleeve 30 and the narrow tube 12 over a length of about 5 mm from the end of the narrow tube 12.

In the arc tube 6 sealed at both sides thereof are dosed about 14 mg of mercury, about 15 mg of dysprosium iodide, about 4 mg of thallium iodide, about 3 mg of sodium iodide, about 1 mg of cesium iodide and about 8 KPa of argon gas as a starting gas.

The arc tube 6 thus arranged was mounted in a vacuum outer bulb 1 to complete a discharge lamp. The characteristics of the discharge lamp developed when it is lit at a power of 250 W in a horizontal burning position were measured. The results are as follows. The lamp characteristics are represented by the value measured after 100 hours of aging.

Lamp power: 250 W
Lamp current: 2.56 A
Lamp voltage: 113.7 V
Total luminous flux: 24,100 l/m
General color rendering index: 83
Color temperature: 4,530 K.

The lamp was then subjected to life test at a power of 250 W in bare and horizontal burning position. As a result, no abnormalities occurred even after about 6,000 hours of passage.

EXAMPLE 2

Similarly, Example 2 using an arc tube 6 having the structure shown in FIGS. 2 and 3 will be described hereinafter. The power consumption of the discharge lamp is 250 W. The inner diameter of the large diameter portion 11A of the main tube body 11 is 13 mm, the inner diameter of the small diameter portion 11C is 7 mm, the curvature radius R of the border of the tapered portion 11B with the small diameter portion 11C is 2 mm, the thickness of the terminal plate 13 is 2.5 mm, the length of the straight cylinder 11D disposed between the position at which the terminal plate 13 is mounted and the tapered portion 11B is 2 mm, the inner diameter of the narrow tube 12 disposed at both ends of the main tube body 11 is 1.5 mm, the protruding length of the electrode is 4 mm, and the distance between the electrodes is 20 mm. The diameter of the electrode core 21 is 0.7 mm. As the first coil 22, a tungsten wire having a diameter of 0.25 mm is wound on the electrode core 21 by four or five turns. The maximum diameter of the first coil 22 is 1.2 mm. The electrically-introducing member 24 is made of molybdenum and has a diameter of 0.5 mm and a length of 3 mm. The electrically-introducing member 27 is a niobium wire having a diameter of 0.7 mm. The ceramic sleeve 30 is made of alumina and has an inner diameter of 0.75 mm, an outer diameter of 1.4 mm and a length of 8 mm. The electrically-introducing member 27 is fixed to the interior of the narrow tube 12 with a sealing glass 40 over a length of about 3 mm from the forward end thereof. As the sealing glass 40 there was used $Al_2O_3$—$SiO_2$—$Dy_2O_3$-based glass. The sealing glass 40 fills the gap between the electrically-introducing members 24, 27 and the alumina sleeve 30 and between the alumina sleeve 30 and the narrow tube 12 over a length of about 5 mm from the end of the narrow tube 12.

In the arc tube 6 sealed at both sides thereof are dosed about 14 mg of mercury, about 15 mg of dysprosium iodide, about 4 mg of thallium iodide, about 3 mg of sodium iodide, about 1 mg of cesium iodide and about 8 KPa of argon gas as a starting gas.

The arc tube 6 thus arranged was mounted in a vacuum outer bulb 1 to complete a discharge lamp. The characteristics of the discharge lamp developed when it is lit at a power of 250 W in a horizontal burning position were measured. The results are as follows. The lamp characteristics are represented by the value measured after 100 hours of aging.

Lamp power: 250 W
Lamp current: 2.60 A
Lamp voltage: 111.8 V
Total luminous flux: 24,000 lm
General color rendering index: 85
Color temperature: 4,250 K.

The lamp was then subjected to life test at a power of 250 W in bare and horizontal burning position. As a result, the discharge lamp was found to have enclosed gas leaked after about 5,800 hours of passage. After test, the surface of the arc tube 6 was carefully observed. As a result, there were observed some fine cracks at the border of the tapered portion 11B with the small diameter portion 11C. However, taking into account the time required until the gas leakage occurs, the discharge lamp was judged to be practically acceptable.

EXAMPLE 3

Similarly, Example 3 using an arc tube 6 having the structure shown in FIGS. 2 and 3 will be described hereinafter. The power consumption of the discharge lamp is 400 W. The inner diameter of the large diameter portion 11A of the main tube body 11 is 16 mm, the inner diameter of the small diameter portion 11C is 10 mm, the curvature radius R of the border of the tapered portion 11B with the small diameter portion 11C is 5 mm, the thickness of the terminal plate 13 is 2.5 mm, the length of the straight cylinder 11D disposed between the position at which the terminal plate 13 is mounted and the tapered portion 11B is 2 mm, the inner diameter of the narrow tube 12 is 2.0 mm, the protruding length of the electrode is 5 mm, and the distance between the electrodes is 25 mm. The diameter of the electrode core 21 is 0.9 mm. As the first coil 22, a tungsten wire having a diameter of 0.45 mm is wound on the electrode core 21 by four or five turns. The maximum diameter of the first coil 22 is 1.8 mm. The electrically-introducing member 24 is made of molybdenum and has a diameter of 0.5 mm and a length of 3 mm. The electrically-introducing member 27 is a niobium wire having a diameter of 0.7 mm. The ceramic sleeve 30 is made of alumina and has an inner diameter of 0.75 mm, an outer diameter of 1.9 mm and a length of 8 mm. The electrically-introducing member 27 is fixed to the interior of the narrow tube 12 with a sealing glass 40 over a length of about 3 mm from the forward end thereof. As the sealing glass 40 there was used $Al_2O_3$—$SiO_2$—$Dy_2O_3$-based glass. The sealing glass 40 fills the gap between the electrically-introducing members 24, 27 and the alumina sleeve 30 and between the alumina sleeve 30 and the narrow tube 12 over a length of about 5 mm from the end of the narrow tube 12. In the arc tube sealed at both sides thereof are dosed about 18 mg of mercury, about 22 mg of dysprosium iodide, about 6 mg of thallium iodide, about 5 mg of sodium iodide, about 3 mg of cesium iodide and about 8 KPa of argon gas as a starting gas.

The arc tube 6 thus arranged was mounted in a vacuum outer bulb 1 to complete a discharge lamp. The characteristics of the discharge lamp developed when it is lit at a power of 400 W in a horizontal burning position were measured. The results are as follows. The lamp characteristics are represented by the value measured after 100 hours of aging.

Lamp power: 400 W
Lamp current: 4.36 A
Lamp voltage: 105.3 V
Total luminous flux: 41,500 lm
General color rendering index: 85
Color temperature: 4,200 K.

The lamp was then subjected to life test at a power of 400 W in bare and horizontal burning position. As a result, no abnormalities occurred even after 6,000 hours of passage.

EXAMPLES 4–6 AND COMPARATIVE EXAMPLES 1–4

Arc tubes of 400 W were produced in the same arrangement as in Example 3 except that the curvature radius R was changed. The relationship between the time required until gas leakage occurs and the curvature radius R was then examined. The results of lighting test on Examples 4, 5 and 6, having a curvature radius R of 4 mm, 3 mm and 2 mm, respectively, and Comparative Examples 1 to 4, having a curvature radius R of 1.5 mm, 1.0 mm, 0.5 mm and 0 mm, respectively, are set forth in the table below. For the lighting test, a 400 W stabilizer was used. In some detail, the arc tube was repeatedly switched on for 5.5 hours and off for 0.5 hours in a bare and horizontal burning position.

| | Curvature radius R | Results of lighting test |
|---|---|---|
| Example 4 | 4 mm | No abnormalities after 6,000 hours |
| Example 5 | 3 mm | No abnormalities after 6,000 hours |
| Example 6 | 2 mm | No abnormalities after 6,000 hours |
| Comparative Example 1 | 1.5 mm | Leak within 3,000 hours |
| Comparative Example 2 | 1.0 mm | Leak within 2,000 hours |
| Comparative Example 3 | 0.5 mm | Leak within 1,000 hours |
| Comparative Example 4 | 0 mm | Leak within 1,000 hours |

The arc tubes which had undergone leakage were then examined for leak position. All these arc tubes were found to have cracks at the border of the tapered portion 11B with the small diameter portion 11C. As can be seen in these test results, the curvature radius R of the foregoing border may be not smaller than 2 mm.

However, the curvature radius R of the border cannot be too great taking into account the following technical restrictions on the production of alumina pipe. In other words, (1) when the curvature radius R is greater than 12 mm, the axial dimension of the small diameter portion 11C cannot be sufficiently secured. (2) When the curvature radius R is greater than 9 mm, the axial dimension of the inner surface of the small diameter portion 11C is not greater than 2 mm, making it impossible to provide the terminal plate 13 with a thickness of not smaller than 2 mm.

Accordingly, the curvature radius R of the border of the tapered portion 11B with the small diameter portion 11C is preferably not smaller than 2 mm and not greater than 12 mm, more preferably not greater than 9 mm.

Industrial Applicability

In accordance with the present invention, a discharge lamp can be provided which can be prevented from cracking on the arc tube due to heat cycle developed when the lamp is switched on and off over an extended period of time and thus exhibits a prolonged life.

It is claimed:

1. A discharge lamp comprising an arc tube of translucent ceramic dosed with a metal halide and electrodes provided in said arc tube whereby discharge occurs across said electrodes, characterized in that a main tube body of said arc tube comprises a large diameter portion, a tapered portion which is disposed at both sides of said large diameter portion and has a smaller diameter toward the forward end thereof and a small diameter portion connected to the forward end of said tapered portions, and said tapered portion and said small diameter portion are connected to each other with a border having a curvature radius of not smaller than 2 mm.

2. The discharge lamp as defined in claim 1, wherein said main tube body comprises a terminal plate of ceramic airtightly fitted in and fixed to the interior of the small diameter portion at both ends thereof and a narrow tube of ceramic having the terminal plate airtightly inserted and fixed therein, and said narrow tube has an electrically-introducing member with said electrodes inserted therein and airtightly sealed thereto with a sealing glass.

3. The discharge lamp as defined in claim 2, wherein the thickness of said terminal plate is from not smaller than 2 mm to not greater than 3 mm.

4. The discharge lamp as defined in claim 2 or 3, wherein a protruding length of the electrode represented by the distance between the end of the small diameter portion and the forward end of the electrode in said arc tube is from not smaller than 3 mm to not greater than 6 mm.

* * * * *